United States Patent [19]

van Roosmalen

[11] 4,268,777

[45] May 19, 1981

[54] CATHODE-RAY TUBE

[75] Inventor: Johannes H. T. van Roosmalen, Eindhoven, Netherlands

[73] Assignee: U.S. Philips Corporation, New York, N.Y.

[21] Appl. No.: 70,552

[22] Filed: Aug. 29, 1979

[30] Foreign Application Priority Data

Sep. 14, 1978 [NL] Netherlands ..... 7809345

[51] Int. Cl.[3] ..... H01J 29/48; H01J 31/38

[52] U.S. Cl. ..... 315/1; 313/389; 313/448; 315/31 R

[58] Field of Search ..... 315/1, 31 R; 313/389, 313/448, 449, 297, 308

[56] References Cited

U.S. PATENT DOCUMENTS

| | | | |
|---|---|---|---|
| 3,801,855 | 4/1974 | Gerlach | 313/389 X |
| 3,831,058 | 8/1974 | Van Roosmalen | 315/31 R |
| 3,866,079 | 2/1975 | Schut | 313/389 |
| 3,870,002 | 3/1975 | Van Roosmalen | 313/389 |
| 3,928,784 | 12/1975 | Weijland | 313/389 |

OTHER PUBLICATIONS

Broerse et al., *An Experimental Light-Weight Color Television Camera,* Philips Technical Review, vol. 29, No. 11, 1968, pp. 325-335.

*Primary Examiner*—Eugene R. La Roche
*Attorney, Agent, or Firm*—Marc D. Schechter

[57] ABSTRACT

A cathode-ray tube having an electron gun to generate an electron beam and a focusing lens to focus the electron beam on a target. The anode of the electron gun forms part of the focusing lens and has a very small aperture to limit the electron beam. In order to prevent positive ions formed in the tube from poisoning the cathode the potential of the anode is at most 75 volts relative to the cathode potential and the distance from the center of the focusing lens to the aperture in the anode is at least equal to 1.5 times the largest dimension of the anode taken in a cross-section at right angles to the axis.

6 Claims, 2 Drawing Figures

CATHODE-RAY TUBE

BACKGROUND OF THE INVENTION

The invention relates to a cathode-ray tube comprising, in an envelope, a target and an electron gun centered along an axis and serving to generate an electron beam directed on the target. The electron gun comprises a cathode and an anode, the anode having a small aperture to limit the electron beam. The cathode-ray tube further comprises a focusing lens to focus the electron beam onto the target. In the focusing lens, the anode, constitutes the first electrode in the direction in which the electrons travel.

Such a cathode-ray tube which is used for recording television pictures is generally known as a vidicon. Between the cathode and the target of the vidicon are present one or more diaphragms to limit the electron beam. The tube furthermore comprises a focusing lens to focus the electron beam on the target.

Such a cathode-ray tube is known from the article "Een Experimentele Kleine Kleurentelevisie-camera" in Phillips Technisch Tijdschrift ("An Experimental Light-Weight Colour Television Camera" in Phillips Technical Review), Volume 29, 1968, No. 11, pages 325–335 in which a television camera tube of the PLUMBICON (trademark) brand is described.

In a PLUMBICON (trademark) brand vidicon, the target consists of a photoconductive layer, comprising a major amount of lead monoxide, which is provided on a transparent signal plate. The free surface of the photoconductive layer faces the electron gun.

The operation of a PLUMBICON (trademark) brand vidicon is as follows. The signal plate is connected to a voltage source via a signal resistor. The potential of the signal plate is positive relative to the cathode potential which is, for reference purposes, zero volts. The scene to be recorded is projected through the transparent signal layer on the photoconductive layer. Under the influence of the positive potential of the signal plate the potentials of local subareas of the target increase as a result of photoconduction. As a result of this a potential image is formed on the free surface of the target, the potentials of the local subareas being dependent on the incident light intensity. The potential image on the target is scanned by an electron beam according to a raster of substantially parallel lines. The potentials of the surface elements of the target are periodically reduced to the potential of the cathode by the scanning electron beam. As a result, an output signal which is proportional image appears as voltage to the original potential fluctuations across the signal resistor.

In the television camera tube described in the above-cited article, the electron gun is formed by a cathode, a grid and an anode. As a result of the lens action between the electrodes, the electron beam is focused between the cathode and the anode in a so-called crossover. The crossover is focused on the target by a focusing lens. The focusing lens comprises three cylindrical electrodes of which the first electrode is formed by the anode. In order to obtain the desired beam at the area of the focusing lens, a beam-limiting diaphragm is provided in the cylindrical anode.

In the above-cited article the cylindrical anode is at a potential of 300 V relative to the cathode potential. At such a high voltage, positive ions are easily formed at the area of the crossover and at the area of the focusing lens as a result of collisions of beam electrons with residual gas in the tube. As a result of the diaphragm in the cylindrical anode the beam current at the area of the focusing lens is much smaller than at the area of the crossover. The number of positive ions formed at the focusing lens thus is much smaller than the number of positive ions formed at the crossover.

The positive ions formed in the manner discussed above follow substantially the original electron path in the opposite direction. Since the electron beam at the area of the focusing lens has a very small apex angle and thus extends substantially parallel to the axis of the electron gun, substantially all the positive ions formed at the focusing lens pass back through the diaphragm. Thus substantially all the positive ions formed at the crossover and at the focusing lens reach the cathode surface; and the ions reach the cathode surface in those places where the cathode emits electrons. In addition a certain focusing of the positive ions on the cathode occurs. The result of this is that the emission of the cathode rapidly deteriorates so that the life of the tube is restricted.

SUMMARY OF THE INVENTION

It is an object of the invention to provide a cathode-ray tube in which the poisoning of the cathode by the positive ions formed in the tube is prevented.

According to the invention, a cathode ray tube, of the kind described above is characterized in that the potential of the anode is at most 75 Volts positive with respect to the cathode potential and the distance between the aperture in the anode and the end of the anode facing the target is at least equal to 1.5 times the largest dimension of the anode taken in a cross-section at right angles to the axis.

The invention is based on the discovery of the fact that by operating the anode at a low potential, substantially no positive ions are formed at the area of the crossover. Since the anode is comparatively long, a substantially field-free space is obtained therein so that it is substantially impossible for the positive ions formed at the focusing lens to trace back a path through the small aperture in the anode.

A cylindrical anode which is at a low potential relative to the cathode potential is known per se from Netherlands Patent Application No. 7013098 (to which U.S. Pat. No. 3,831,058 corresponds). The cathode-ray tube described in this Application is of the type in which substantially no crossover is formed between the cathode and the anode. The anode comprises a very small aperture which serves as an object to be imaged on the target by the focusing lens. The electron paths of the electrons emitted by the cathode extend substantially parallel to the axis of the electron gun. As a result, positive ions formed bombard the cathode surface uniformly. In the embodiment described in the above-cited Patent Application, the potential of the cylindrical anode is 50 V positive relative to the cathode potential. Although the number of positive ions formed between the cathode and the anode is restricted by the low potential of the cylindrical anode, the special measures according to the invention are required to prevent positive ions formed at the focusing lens from reaching the cathode.

In a cathode-ray tube embodying the invention the diameter of the aperture in the anode is at most 100 μm.

A cathode-ray tube embodying the invention is preferably characterized in that the focusing lens is formed by the anode, which is at a low potential relative to the cathode potential and a second electrode which is at a potential, which is at least twice as high.

BRIEF DESCRIPTION OF THE DRAWINGS

The invention will be described in greater detail with reference to the accompanying drawing.

DESCRIPTION OF THE PREFERRED EMBODIMENTS

Figure 1:
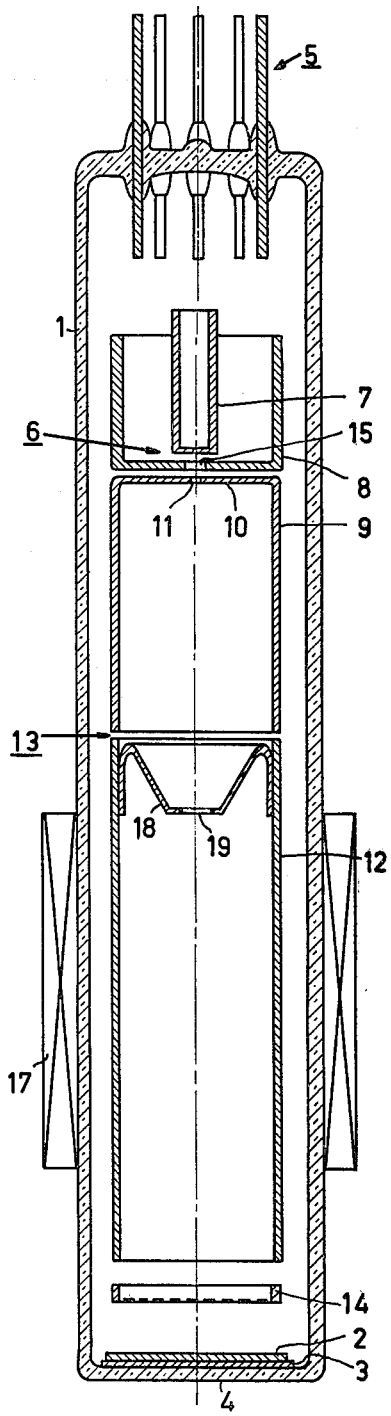
FIG. 1 is a sectional view of a cathode-ray tube according to the invention.

The cathode-ray tube shown in FIG. 1 is similar to PLUMBICON (trademark) brand vidicon. The tube has a cylindrical glass envelope 1. The tube comprises a target 2 consisting of a photoconductive layer, comprising mainly lead monoxide, vapor-deposited on a signal plate 3. The signal plate 3 is a very thin readily conducting transparent layer of tin oxide provided on the inside of the window 4 of the envelope 1.

On the opposite side of the envelope the connection pins 5 of the tube are situated.

Centered along the axis of the envelope 1 is the rotationally symmetrical electron gun 6. The electron gun 6 comprises a cathode 7, a control grid 8 and a cylindrical anode 9. The control grid 8 has an aperture 15. The cylindrical anode 9 comprises a diaphragm 10 having a small aperture 11.

The cylindrical anode 9 together with a second cylindrical electrode 12 and electrode 18 constitutes a focusing lens 13 for focusing the electron beam on the target. On its side facing the anode 9, the electrode 12 has a diaphragm 18 with an aperture 19 to reduce aberrations in the electron beam on the target caused by the focusing lens. The tube further comprises a gauze electrode 14 which causes the electrons to land on the target 2 perpendicular to the surface of the target the end of electrode 12 facing the target 2 also faces the electrode 14.

The envelope 1 of the tube is partly surrounded by line deflection coils and field deflection coils which are collectively denoted by 17. The connection means of the electrodes and the various supply leads to the electrodes are not shown to avoid complexity in the drawing.

The target 2 is scanned by the electron beam according to a raster of substantially parallel lines. During the scan periods the local subregions on the target 2 are stabilized to substantially the cathode potential which is referenced at zero volts. The potential of the grid 8 is −25 V relative to the cathode potential and the potential of the anode 9 is 50 V positive relative to the cathode potential. The grid 8 is at a distance of 0.1 mm from the cathode and has a thickness of 0.1 mm. The aperture 15 in the grid has a diameter of 1 mm. The cylindrical anode 9 is at a distance of 0.1 mm from the grid 8 and has an inside diameter of 10 mm. The length of the anode 9 is 22 mm. The aperture 11 in the diaphragm 10 has a diameter of 40 μm. As a result of the lens action between the cathode 7, the grid 8 and the anode 9, a crossover is formed between the cathode 7 and the anode 9 during the scan period. The beam is limited by the aperture 11 in the diaphragm 10 of the anode 9 and is focused on the target by the focusing lens 13. The focusing lens is formed by the anode 9 at a potential of 50 V and electrodes 12 at a potential of 300 volts positive relative to the cathode potential. Since the anode 9 is at a low potential, a very small number of positive ions are formed between the cathode 7 and the anode 9.

The beam emanating from the aperture 11 has a comparatively large apex angle. In fact, according to known laws of electron optics, the apex angle of the beam is inversely proportional to the product of the diameter of aperture 11 and the square root of the voltage on the anode 9 taken with respect to the cathode voltage. Since the aperture 11 is at a distance of 22 mm from the focusing lens 13 the electron beam at the area of the focusing lens has a comparatively large diameter. As a result of the high potential of 300 Volts applied to the electrode 12, positive ions are easily formed at the area of the focusing lens 13. The positive ions have substantially no initial velocity and move in a direction perpendicular to the equipotential planes of the focusing lens. The equipotential planes vary in such a manner that only the positive ions formed in a narrow region along the axis of the electron gun move parallel along the axis in the direction of the aperture 11. Since the length of the anode 9 is equal to 2.2 times the diameter of the focusing lens 13, the field of the electrode 12 which is at a potential of 300 V influences anode 9 to only a small degree. As a result of this, a substantially field-free space is formed in the anode 9 so that it is substantially impossible for the ions formed along the axis of the electron gun to reach the very small aperture 11 in the anode 9.

Figure 2:
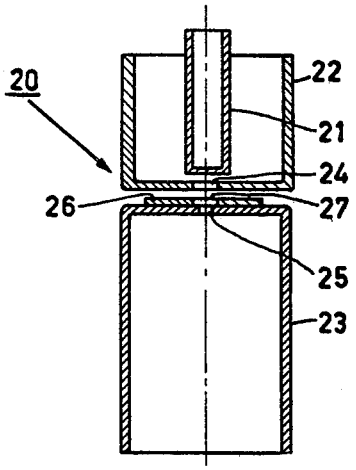
FIG. 2 shows a sectional view of another embodiment of the electron gun shown in FIG. 1.

FIG. 2 shows another embodiment of the electron gun shown in FIG. 1. The electron gun 20 comprises a cathode 21, a grid 22 and an anode 23. The potential of the grid 22 is 6.5 V negative relative to the cathode potential and the potential of the anode 23 is 50 V positive relative to the cathode potential. The grid 22 is at a distance of 0.1 mm from the cathode and has a thickness of 0.1 mm. The aperture 24 in the grid 22 has a diameter of 1.5 mm. The cylindrical anode 23 is at a distance of 0.1 mm from the grid 22 and has a diameter of 10 mm. The length of the anode 23 is 18 mm. The anode 23 has an aperture 25 of a diameter of 50 μm. The aperture 25 is covered by a diaphragm 26 having an aperture 27 with a diameter of 0.9 mm. At the given potentials, such an electrode configuration behaves as a so-called diode gun, which is known per se from Netherlands Patent Application No. 7013098 (to which U.S. Pat. No. 3,831,058 corresponds). The electron paths of the electrons emitted by the cathode extend substantially parallel to the axis of the electron gun. Thus, during the scan periods no crossover is formed. The aperture 25 serves as an object to be imaged on the target by the focusing lens.

In such an electron gun in a cathode-ray tube as shown in FIG. 1 positive ions are easily formed due to the large potential difference which the electrons have traversed at the area of the focusing lens. Since the focusing lens is at a comparatively large distance from the aperture 25 in the diaphragm 26 and the cylindrical anode 23 substantially forms an equipotential space at a potential of 50 volts, it is substantially impossible for the formed positive ions to trace back a path through the small aperture 25.

Since in a cathode-ray tube embodying the invention the positive ions formed no longer reach the cathode, the tube need no longer be evacuated so carefully. It has been found that a cathode-ray tube may be operated at a gas pressure of $10^{-2}$ to $10^{-3}$ Torr without the ions poisoning the cathode.

What is claimed is:

1. A cathode-ray tube comprising:

an envelope;

a target;

an electron gun, centered along an axis in the envelope, comprising a cathode and an anode, said electron gun the target, said anode being elongated and having a small aperture to limit the electron beam and having an end facing the target; and a focussing lens, to focus the electron beam on the target, comprising at least two electrodes, the first electrode, viewed in the direction from the electron gun to the target, being the anode;

characterized in that the distance between the aperture in the anode and the end of the anode facing the target is at least 1.5 times the largest dimension of the anode taken in a cross-section perpendicular to the axis; and in operation the potential applied to the anode is at most 75 volts positive with respect to the potential of the cathode.

2. A cathode-ray tube as claimed in claim 1, characterized in that the diameter of the aperture in the anode is at most 100 microns.

3. A cathode-ray tube as claimed in claim 2, characterized in that in operation the potential applied to the second electrode of the focussing lens is at least twice as high as the anode potential.

4. A cathode-ray tube as claimed in claim 3, characterized in that the electron gun further comprises a grid, having an aperture which is larger than the aperture in the anode, located between the cathode and anode.

5. A cathode-ray tube, for operation at an anode potential of at most 75 volts positive with respect to a cathode, comprising:

an envelope;

a target;

an electron gun, centered along an axis in the envelope, comprising the cathode and the anode, said electron gun functioning to generate an electron beam to be directed onto the target, said anode being elongated and having an end facing the target; and a diaphragm having a small aperture to limit the electron beam, said aperture being located between the cathode and the end of the anode facing the target;

characterized in that the distance between the aperture in the diaphragm and the end of the anode facing the target is at least 1.5 times the largest dimension of the anode taken in a cross-section perpendicular to the axis.

6. A cathode-ray tube comprising:

an envelope;

a target;

an electron gun, centered along an axis in the envelope, comprising a cathode and an anode, said electron gun functioning to generate an electron beam to be directed onto the target, said anode being elongated and having a small aperture to limit the electron beam and having an end facing the target; and a focussing lens, to focus the electron beam on the target, comprising at least two electrodes, the first electrode, viewed in the direction from the electron gun to the target, being the anode;

characterized in that the distance between the aperture in the anode and the end of the anode facing the target is at least 1.5 times the largest dimension of the anode taken in a cross-section perpendicular to the axis; and further comprising means for applying a potential to the anode which is at most 75 volts positive with respect to the potential of the cathode.

* * * * *

UNITED STATES PATENT AND TRADEMARK OFFICE

CERTIFICATE OF CORRECTION

PATENT NO. : 4,268,777

DATED : May 19,1981

INVENTOR(S) : JOHANNES H. T. VAN ROOSMALEN

It is certified that error appears in the above—identified patent and that said Letters Patent is hereby corrected as shown below:

Col. 5, Line 7, Claim 1, After " gun " insert -- functioning to generate an electron beam to be directed onto --

Signed and Sealed this

*Twenty-seventh* Day of *October 1981*

[SEAL]

*Attest:*

GERALD J. MOSSINGHOFF

*Attesting Officer*

*Commissioner of Patents and Trademarks*